US005472291A

United States Patent [19]

Vogel

[11] Patent Number: 5,472,291

[45] Date of Patent: Dec. 5, 1995

[54] PROCESS AND DEVICE FOR DE-ICING ROADWAYS

[75] Inventor: Otto Vogel, Buch am Erlbach, Germany

[73] Assignee: CTS Consulting GmbH, Buch am Erlbach, Germany

[21] Appl. No.: 969,241

[22] PCT Filed: Jun. 27, 1992

[86] PCT No.: PCT/EP92/01452

§ 371 Date: Apr. 19, 1993

§ 102(e) Date: Apr. 19, 1993

[87] PCT Pub. No.: WO93/00481

PCT Pub. Date: Jan. 7, 1993

[30] Foreign Application Priority Data

Jun. 29, 1991 [DE] Germany ..... 41 21 608.3

[51] Int. Cl.[6] ..... E01C 11/24

[52] U.S. Cl. ..... 404/72; 404/71; 404/75; 404/111

[58] Field of Search ..... 37/227, 228, 229, 37/230; 404/72, 75, 77, 110, 111, 71, 95, 97

[56] References Cited

U.S. PATENT DOCUMENTS

| | | | |
|---|---|---|---|
| 2,845,058 | 7/1958 | Wadsworth | 37/227 X |
| 2,893,377 | 7/1959 | Janousek | 37/227 X |
| 3,456,368 | 7/1969 | Jacques | 37/227 |
| 3,475,056 | 10/1969 | Jones | 37/227 X |
| 4,271,617 | 6/1981 | Yoshizawa | 37/227 X |

FOREIGN PATENT DOCUMENTS

| | | | |
|---|---|---|---|
| 2061047 | 6/1972 | Germany | 404/71 |

OTHER PUBLICATIONS

Revue Générale des Chemins de Fer (1983) Jan., Paris France, p. 58 "A l'Étranger".

*Primary Examiner*—Dave W. Arola
*Assistant Examiner*—Andrea Chop
*Attorney, Agent, or Firm*—Cohen, Pontani, Lieberman, Pavane

[57] ABSTRACT

A process for de-icing roadways to which is applied a melting agent to lower the freezing point. In order to save melting agent (salt), the melt water running off the roadway is collected and re-used for de-icing purposes provided that its melting agent content is adequate. To implement the process, use is made of a device for de-icing roadways including, along the length of the roadway, components such as spray nozzles (34) to apply the melting agent and run-off channels (16) to divert the water into a drainage channel (18) connected to a collector channel in its cycle. According to the invention, the run-off channels (16) lead into at least one collector tank (20) which returns the adequately concentrated melt water to the spray nozzles (34) via a supply line (26).

17 Claims, 1 Drawing Sheet

PROCESS AND DEVICE FOR DE-ICING ROADWAYS

FIELD OF THE INVENTION

The invention relates to a process for de-icing roadways in which a melting agent is applied to lower the freezing point, and, more particularly, to a process and system in which a run-off solution of water and the melting agent is recovered so that at least some of the melting agent may be reused.

DESCRIPTION OF THE PRIOR ART

In order to keep road surfaces of frequently travelled roads and particularly expressways free of ice or free them from ice and snow in winter, generally a melting agent is applied that consists of salt, which then lowers the freezing point of water, so that the ice will melt at relatively low temperatures. A disadvantage of this process is that it requires a relatively large amount of salt which is lost after application. This is not only costly but also damaging to the environment. The amount of melting agent used is particularly high for so-called whisper-asphalt due to the open pores of this type of road surface.

SUMMARY OF THE INVENTION

It is therefore an object of the present invention to provide a process for the de-icing of roadways that considerably reduces the usage of melting agent in order to not only lower costs but also noticeably limit environmental damage.

The aforementioned object, as well as others which will become apparent to those skilled in the art, is to provide a system and method for collecting and recirculating at least a portion of the melting agent contained in run-off leaving the roadway surface. In accordance with the present invention, at least a portion of the recirculated runoff is reused for roadway deicing purposes.

The melt water that has run-off and has been collected generally consists of a salt solution whose concentration allows it to be reused as a melting agent. This has the advantage of not only visibly reducing the amount of salt used but also achieving cost savings in men and materials for winter service.

It is advantageous that the solution run-off be tested for its concentration of melting agent. If the concentration of melting agent in the melted water is very low, the water can be diverted into a drainage receptacle 35, otherwise, if the concentration is adequate, it can be reused for de-icing.

In any event, it may be desirable to again test the concentration of melting agent in the collected run-off solution prior to spraying the same onto the road surface again so that adjustments, if necessary, may be made to achieve the desired concentration.

According to the invention, drainage channels provided along the roadway lead into at least one collector tank which is connected to the facilities for applying the melting agent.

Increasingly collector tanks for run-off are being planned and installed, particularly along expressways, in order to isolate the run-off in case of accidents. Accordingly the additional construction costs for the implementation of the system and method proposed by the invention are economically justifiable. It is sufficient to have one return line lead from the respective collector tank to the facilities for applying the melting agent, generally spray nozzles, by which the recycled melting agent (salt solution) is again sprayed onto the road surface.

The device can be implemented in such a manner that a switch is inserted in the direction of flow before the collection tank. This switch is connected to a first sensor that measures the concentration of the melting agent and diverts collected run-off solution into a drainage receptacle, such as a sewer or a dry well, should the concentration be too low, or the collector tank, should the concentration be adequate.

Taking the invention further, a second switch, connected to a second sensor for measuring the concentration of the melting agent, is inserted into the supply line which leads to the facilities for applying the melting agent. If the melt water has the desired concentration, this switch connects the supply line to the facilities for applying the melting agent, if the melt water deviates from the desired concentration, a feeder line opens to add water or melting agent.

In this manner the concentration of the melting agent can be adjusted to the desired value before reapplication onto the road surface.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE INVENTION

Figure 1:
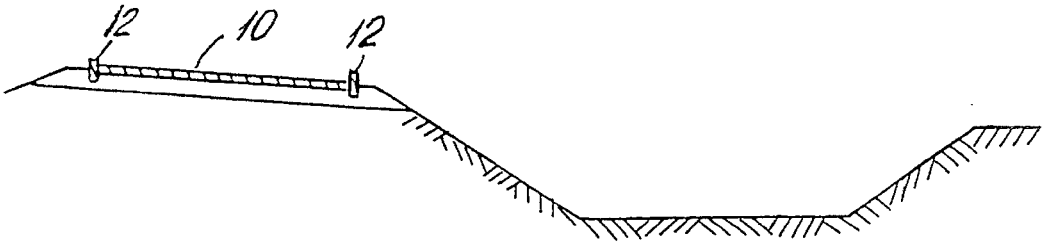
FIG. 1 is a cross-section of a roadway along which a device for implementing the process has been installed.

Both figures show a roadway 10 with a raised curb 12 (curbstones) along both sides, with FIG. 1 showing the lateral inclination of the roadway 10. Due to this lateral inclination water runs off into the drains 14 behind the right curb 12 in the figure. The drains are connected via run-off channels 16 to a common drainage channel 18. The drainage channel 18 leads to a collector tank 20; a number of such collector tanks 20 are provided along the roadway 10 at certain distances so that water containing oil from a possible accident with a tank truck can be diverted in a controlled manner. The collector tanks 20 are connected with a drainage receptacle 35.

Figure 2:
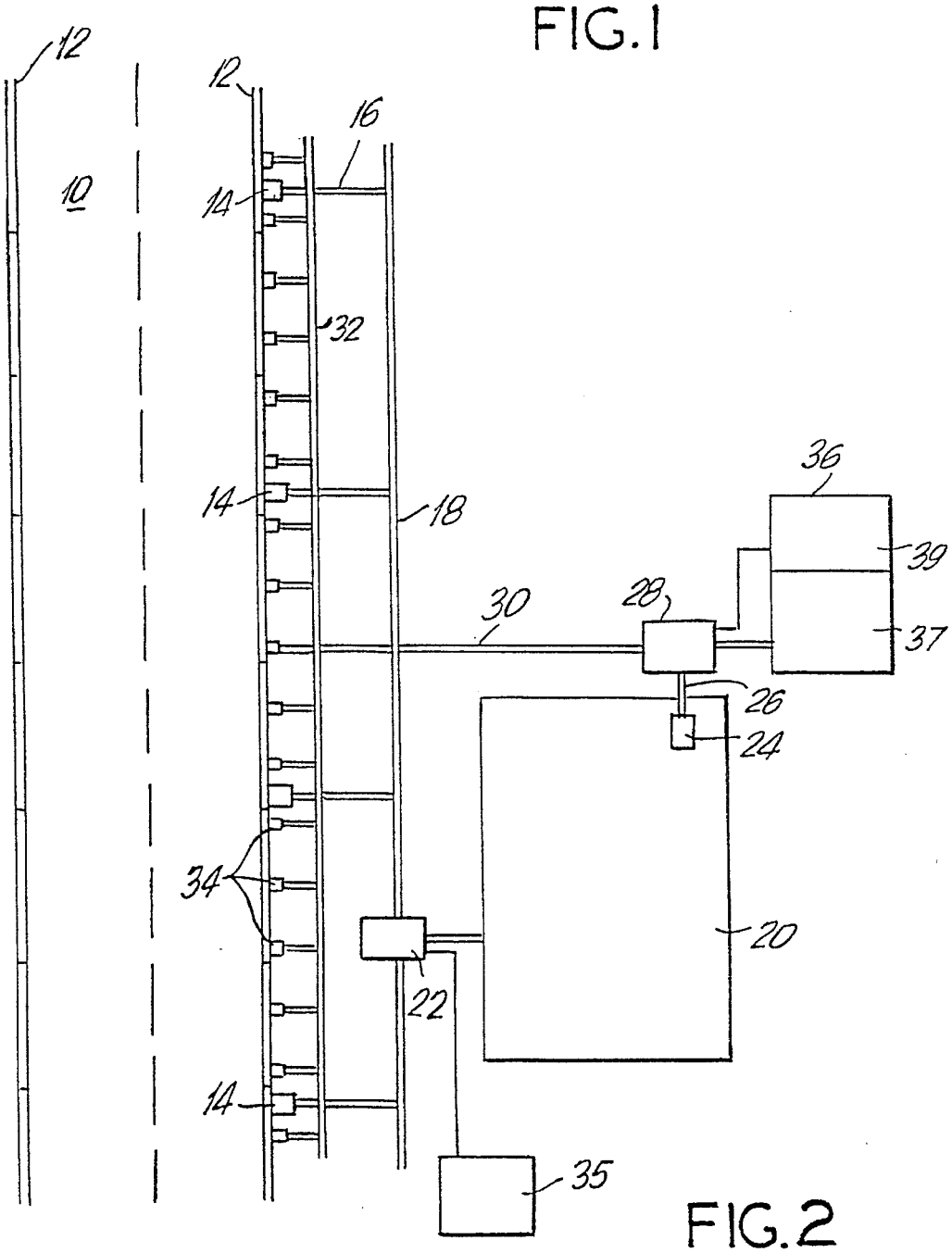
FIG. 2 is a schematic top view of the roadway with the device according to the invention.

FIG. 2 shows a first sensor 22 being installed between the collector tank 20 and the drainage channel 18 which can activate a switching valve. If the sensor 22 registers too low a concentration of melting agent, it sets the valve in such a manner that the run-off is diverted to a drainage receptacle 35, such as a sewer or a dry well, while for a higher concentration, allowing the recycling of the melt water, the valve is switched so that the melt water is diverted to the collector tank 20.

A supply line 26 which is connected to a suction pump 24 leads from the collector tank 20 to a second switch 28 which is controlled by a second sensor. A line 30 connects switch 28 with a feeding pipe 32 to which a number of facilities 34 (spray nozzles) for applying the melting agent to the roadway 10 are fastened. The switch 28 is also connected by a pair of conduits to an intermediate tank 36 containing a highly concentrated solution of melting agent 37 and/or water 39.

The sensor connected to the switch 28 measures the melting agent concentration of the melt water to be recycled before it reaches the facilities 34 (spray nozzles). If the current concentration deviates from the desired concentration, a highly concentrated solution of melting agent, or water, is added to the melt water before it continues via the switch 28 until the desired concentration is reached. Only then the switch 28 changes over allowing the continuation to line 30 and from there to the facilities 34.

The device can be automated by way of sensors which measure the temperature and humidity of the surrounding air, thus causing the suction pump 24 and switch 28 connected to the second sensor to be automatically turned on when there is danger of black ice forming.

I claim:

1. A process for de-icing a roadway surface comprising the steps of:

applying a melting agent to the roadway surface in an amount effective to lower the freezing point of water to produce a run-off mixture containing water and said melting agent;

collecting at least a portion of the run-off mixture;

re-applying at least a portion of the run-off mixture collected during said collecting step to the roadway surface, thereby reusing a portion of the melting agent applied during said applying step; and detecting the concentration of melting agent in the run-off mixture prior to said re-applying step.

2. The process according to claim 1 further including a step of diverting at least some of the run-off mixture prior to said re-applying step.

3. The process according to claim 2, wherein said diverting step includes directing at least some of the run-off mixture to a collecting tank if a concentration of melting agent in the run-off mixture equals or exceeds a predetermined level.

4. The process according to claim 3, further including a step of adjusting the concentration of melting agent in the run-off mixture diverted during said diverting step to an amount effective to lower the melting point of water.

5. The process according to claim 4, wherein said adjusting step includes adding melting agent to the diverted run-off mixture.

6. The process according to claim 4, wherein said adjusting step includes adding water to the diverted run-off mixture.

7. The process according to claim 4, further including a step of detecting the concentration of melting agent in the diverted run-off mixture contained in said collecting tank prior to said adjusting step.

8. The process according to claim 2, wherein said diverting step comprises directing at least some of the run-off mixture to a drainage receptacle.

9. An apparatus for de-icing a roadway surface having means for applying to the roadway surface an amount of melting agent effective to lower the melting point of water thereon, and at least one run-off channel disposed along the roadway for receiving a run-off mixture containing water and the melting agent, said apparatus comprising:

means for detecting a concentration of the melting agent in the run-off mixture; and collecting means connectable in fluid communication with the applying means for receiving the run-off mixture from the at least one run-off channel and supplying at least a portion of the run-off mixture to the applying means when the concentration of the melting agent therein is at least equal to a predetermined level, whereby said at least a portion of the run-off mixture is recycled for de-icing of the roadway surface.

10. The apparatus of claim 9, wherein said collecting means includes a collecting tank and means responsive to said detecting means for diverting the run-off mixture received from the at least one run-off channel to said collecting tank when a concentration of melting agent detected therein is at least equal to said predetermined level.

11. The apparatus of claim 10, wherein said diverting means is further adapted to discharge a run-off mixture having a concentration of melting agent below said predetermined level to a drainage receptacle.

12. The apparatus of claim 10, wherein said collecting means further includes means for establishing fluid communication between said collecting tank and the applying means and thereby directing run-off mixture therebetween, and second means for detecting a concentration of melting agent in run-off mixture flowing through said establishing means.

13. The apparatus of claim 12, further including means responsive to said second detecting means for adjusting the concentration of melting agent in run-off mixture flowing through said establishing means.

14. The apparatus of claim 13, wherein said adjusting means is operable to increase melting agent concentration by adding melting agent and to decrease melting agent concentration by adding water.

15. An apparatus for de-icing a roadway surface, comprising:

applying means for applying to said roadway surface an amount of melting agent effective to lower the melting point of water thereon;

drain means disposed proximate said roadway surface for receiving a run-off mixture containing water and the melting agent:

detecting means for detecting a concentration of the melting agent in the run-off mixture; and collecting means connectable in fluid communication with the applying means and drain means for receiving the run-off mixture from said drain means and for supplying at least a portion of received run-off mixture to the applying means when a concentration of melting agent detected therein is at least equal to a predetermined level, whereby at least some of the run-off mixture is recycled for de-icing of the roadway surface.

16. The apparatus of claim 15, wherein said applying means includes at least one nozzle for spraying run-off mixture received from said collecting means onto said roadway surface.

17. The apparatus of claim 15, wherein said collecting means includes a collecting tank and means responsive to said detecting means for diverting the run-off mixture received from the drain means to said collecting tank when a concentration of melting agent detected therein is at least equal to said predetermined level.

* * * * *